US005402117A

United States Patent [19]

Zijderhand

[11] Patent Number: 5,402,117

[45] Date of Patent: Mar. 28, 1995

[54] METHOD OF COLLECTING TRAFFIC INFORMATION, AND SYSTEM FOR PERFORMING THE METHOD

[75] Inventor: Frans Zijderhand, Eindhoven, Netherlands

[73] Assignee: U.S. Philips Corporation, New York, N.Y.

[21] Appl. No.: 160,320

[22] Filed: Nov. 29, 1993

Related U.S. Application Data

[63] Continuation of Ser. No. 886,675, May 21, 1992, abandoned.

[30] Foreign Application Priority Data

May 27, 1991 [EP] European Pat. Off. ..... 91201253
Nov. 21, 1991 [EP] European Pat. Off. ..... 91203035

[51] Int. Cl.[6] ..... G08G 1/0967; G08G 1/09
[52] U.S. Cl. ..... 340/905; 340/988
[58] Field of Search ..... 340/904, 907, 901, 905, 340/934, 988; 364/424.02, 444, 436, 437; 379/59

[56] References Cited

U.S. PATENT DOCUMENTS 4,688,244 8/1987 Hannon et al. ..... 340/825.35 X
5,131,020 7/1992 Liebesny ..... 340/905
5,173,691 12/1992 Sumner ..... 340/905
5,208,756 5/1993 Song ..... 340/991

FOREIGN PATENT DOCUMENTS 0292897 5/1988 European Pat. Off. .

OTHER PUBLICATIONS

Suchowerskyj, "Vehicle Navigation and Information Systems in Europe–An Overview", Vehicle Electronics in the 90's: Proceedings of the International Congress on Transportation Electronics, Oct. 1990, pp. 209–215.

Catling et al., "Rod Transport Informatics in Europe–Major Programs and Demonstrations", IEEE Transactions on Vehicular Technology, vol. 40, No. 1, Feb. 1991, pp. 132–140.

"Ali–Scout–A universal guidance and information system for road traffic", R. von Tomkewitsch, Second International Conference on Road Traffic Control, 15–18 Apr. 1986.

J. R. Easteal, "Implementing the Pan–European Cellular System", Pan–European Mobile Communications, Winter 1989/1990, IBC Technical Services Ltd., pp. 101–104.

*Primary Examiner*—Hezron E. Williams
*Assistant Examiner*—Christine K. Oda
*Attorney, Agent, or Firm*—Robert J. Kraus

[57] ABSTRACT

Via a cellular radio communication system, measured values are transmitted from vehicles to a computer. The measured values are chosen so that they can be used to determine Origin-Destination matrices without infringing upon the privacy of the users.

8 Claims, 3 Drawing Sheets

| σ \ D | 1 | 2 | 3 | 4 |
|---|---|---|---|---|
| 1 | 0 | 117 | 652 | 89 |
| 2 | 212 | 0 | 173 | 974 |
| 3 | 578 | 155 | 0 | 43 |
| 4 | 67 | 866 | 52 | 0 |

METHOD OF COLLECTING TRAFFIC INFORMATION, AND SYSTEM FOR PERFORMING THE METHOD

This is a continuation of prior application Ser. No. 07/886,675, filed on May 21, 1992, abandoned.

BACKGROUND OF THE INVENTION

The invention relates to a method of collecting traffic information by receiving measured values, transmitted from at least one vehicle, in respect of location and movement of the relevant vehicle.

The invention also relates to a system for performing the method.

A method of this kind is known from the article "Ali-Scout—A universal guidance and information system for road traffic", R. von Tomkewitsch, Second International Conference on Road Traffic Control, 15–18 Apr. 1986. The cited article describes a traffic guidance system in which vehicles comprise a navigation device which guides the user to a preselected destination by means of a position-finding device and data concerning the local road network and current traffic situation as generated by a central computer and transmitted by guidance beacons. For traffic-dependent guidance it is necessary for the central computer to have available current traffic information which is provided by the vehicles themselves, the vehicles transmitting measured values (such as travel times and waiting times on route segments determined by the guidance beacons) to the guidance beacons which transmit this data to the central computer for processing.

It is a drawback of such a method that it requires a complex and expensive network of guidance beacons with infrared transmitters and receivers in the vehicles as well as in the beacons.

SUMMARY OF THE INVENTION

It is inter alia an object of the invention to provide a less expensive and more efficient method. To achieve this, a method in accordance with the invention is characterized in that said measured values are defined relative to virtual reference positions and are transmitted in a cellular radio communication system via the communication mechanism of an actual cell. A cellular radio communication system, for example as introduced in Europe in 1991, offers an extensive mobile and portable communication network enabling vehicles or other users to transmit and receive digitized data via a radio link. The use of radio channels in this system and the definition of the data relative to virtual reference positions renders the network of guidance beacons superfluous. For more detailed information regarding this system, reference is made to the article "Implementing the Pan-European Cellular System", J. R. Easteal, Pan-European Mobile Communications, Winter 1989/90, IBC Technical Services Ltd, pp. 101–104.

A preferred version of a method in accordance with the invention is characterized in that per vehicle the transmitted measured values contain, for each intersection passed, indications in respect of a route segment travelled by the vehicle so as to reach the intersection as well as in respect of a route segment travelled by the vehicle beyond the intersection. This offers a special advantage in that these measured values can be used to determine the so-called Origin-Destination (O-D) matrix for each intersection, and hence the O-D matrix of an entire area, without infringing upon the privacy of the user. For a given set of origins and destinations such an O-D matrix provides the frequencies at which vehicles depart from a given origin to a given destination. This enables authorities not only to improve the traffic infrastructure (for example by readjustment of traffic lights), but also to generate short-term traffic guidance recommendations to stimulate the flow of traffic. The data necessary for determining O-D matrices is customarily collected by means of video cameras monitoring the traffic flows at each intersection. This is a cumbersome and expensive approach, notably when the measurements are often repeated in order to update the data. The measured values transmitted in the cited Ali-Scout traffic guidance system are not suitable for calculating O-D matrices. An obvious solution to this problem would be the additional transmission by the vehicles of their destination; however, this has a major drawback in that the privacy of the users is then seriously affected. The method in accordance with the invention offers sufficient data for the determination of the O-D matrices, it nevertheless being impossible to trace individual users even in the case of low traffic densities. It is to be noted that this preferred version of the method can in principle also be used without a cellular radio communication system; however, in that case facilities must be provided at each intersection for the transmission of the data which is, of course a drawback.

BRIEF DESCRIPTION OF THE DRAWING

The invention will be described in detail hereinafter with reference to the following Figures; therein.

DESCRIPTION OF THE PREFERRED EMBODIMENT

Figure 1:
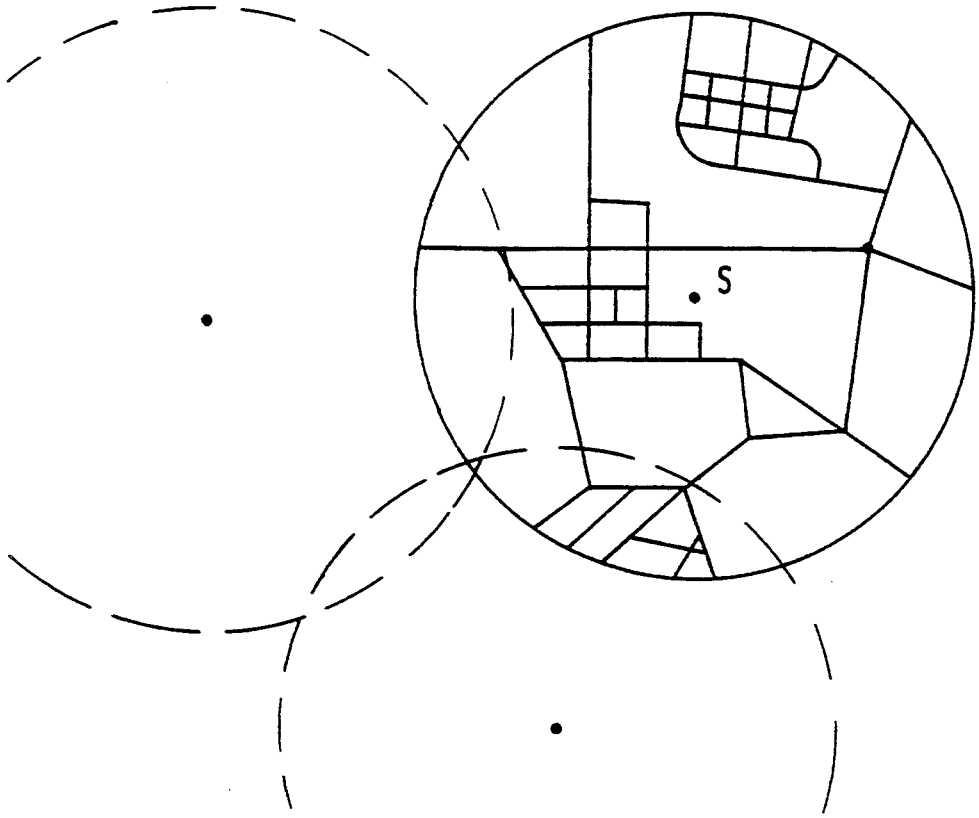
FIG. 1 illustrates the cellular structure of the radio communication system.

FIG. 1 shows a number of cells of a radio communication system. In this case they have a circular shape with adequate overlap for full coverage of a region. Other cell shapes, of course, are also feasible. A cell of this kind corresponds to a geographic sub-region of a larger geographic region. Within the cell there is situated a transmitter/receiver station S whereto vehicles within the relevant cell can transmit data via a radio link. Each cell has its own radio frequency or radio channel and the range of the transmitter/receiver station is decisive as regards the dimensions of the relevant cell. The vehicles comprise a number of sensors (for example, magnetic sensors for direction finding and wheel sensors for determining the distance travelled) which, on the basis of their measurements, enable accurate determination of the location and the direction of movement of the vehicle by a navigation device, for example, the CARIN (Car Information and Navigation System) system, aboard the vehicle. To this end, the navigation device has available a digitized map of the area (for example, on CD-ROM) which contains all roads, composed of route segments, of the relevant region. Hereinafter, the term "intersection" or "junction" is to be understood to mean: any point of the road network where a vehicle can make a choice as regards continuation of its travel (i.e. three-forked roads, intersections, roundabouts and the like). Each segment of the road network between two intersections will be referred to hereinafter as a "route segment". Thus, a vehicle can determine at any instant its position on the map, i.e. which route segment is being followed at that instant. The digitized map forms a reference framework consisting of virtual reference positions. The measured values transmitted to the transmitter/receiver station S of a cell by a vehicle are defined in relation to these reference positions (for example, representations on the map of intersections or fuel stations along a highway); for example, a transmitted travelling time relates to the complete route completed between two given intersections. Therefore, the reference positions need not be represented by physical units such as beacons. The transmitter/receiver station S of each cell communicates with a central computer which collects and analyses the transmitted measured values. On the basis of the analysis of the traffic situation by the central computer, it can generate traffic guidance recommendations for transmission to the vehicles. The drivers of the vehicles can thus be informed about congestions caused by accidents, back-ups and the like. The flow of traffic is thus improved.

Figures 2, 3:
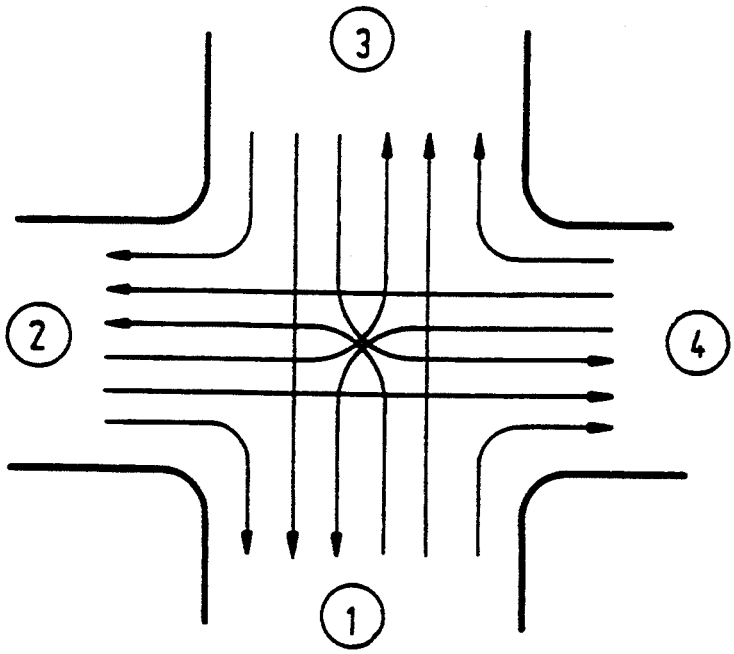
FIG. 2 shows an intersection with traffic flows.
FIG. 3 shows an O-D matrix associated with the intersection.

FIG. 2 shows an intersection of roads. The traffic arrives from the directions or route segments numbered from 1 to 4. At this intersection each vehicle has the choice from three route segments for continuing its travel. Therefore, there are 12 traffic flows which are represented by arrows in the Figure. In a preferred embodiment of the invention, after passage of an intersection the following information is transmitted to the transmitter/receiver station S by each vehicle: an indication of the route segment followed by the vehicle so as to reach the relevant intersection and an indication of the route segment followed by the vehicle beyond the intersection. For example, a vehicle coming from the route segment via and continuing on the route segment 4 will transmit, after the right-hand turn at the intersection, the combination of the route segment 1 followed by the route segment 4 to the transmitter/receiver station S. Should a given vehicle temporarily not have the opportunity to transmit the data (for example, because the channel is busy), the indications of the route segments followed can be saved for a plurality of intersections until transmission of the data thus saved is possible. In such a case traffic will be rather busy, so that the privacy of the relevant user will not be affected, despite the transmission of the route indications relating to successive intersections.

FIG. 3 shows an Origin-Destination matrix associated with the intersection of FIG. 2. The 12 traffic flows of the intersection have been counted during a given time interval. Evidently, this is possible only by way of the described transmission of the measured values in accordance with the invention. It can be seen from FIG. 3, for example that during the time interval of the measurement 89 vehicles originating from the route segment 1 continued their travel via the route segment 4. Such an O-D matrix can also be translated (by simple normalization) into a percentual O-D matrix; the sum of the values of each row of the matrix is then 100. In a non-normalized O-D matrix, the sum of the values of each row represents the inflow via the relevant route segment and the sum of the values of each column represents the butflow via the relevant route segment. On the basis of this data, the authorities (the central computer) can optimize, for example the setting of traffic lights at the intersection. It is also possible to combine O-D matrices of neighbouring intersections, provided of course that they relate to the same time interval. Thus, for a given region an O-D matrix can also be determined from the O-D matrices of the constituent intersections of the relevant region. On the basis thereof the authorities can supply the users with traffic guidance recommendations via the cellular radio communication system. A major advantage of the collection of the traffic information in accordance with the invention consists in that the determination of the O-D matrices (or other measurements) can be simply repeated and hence continuously updated. The central computer can thus generate recommendations which fully correspond to the current traffic situation. The known step of making each vehicle transmit also its travelling time for its last route segment travelled thus also has a synergetic effect: in combination with the derived O-D matrices, even more accurate traffic guidance is possible. Another major advantage of the method in accordance with the invention consists in that the users need not make their final destination known. As a result of the transmission of the relevant route segments per intersection, the data required can be virtually anonymously collected. This is because it is impossible to track a given vehicle along its route through the cell, even in the case of low traffic density. The privacy of the drivers is thus ensured.

Figure 4:
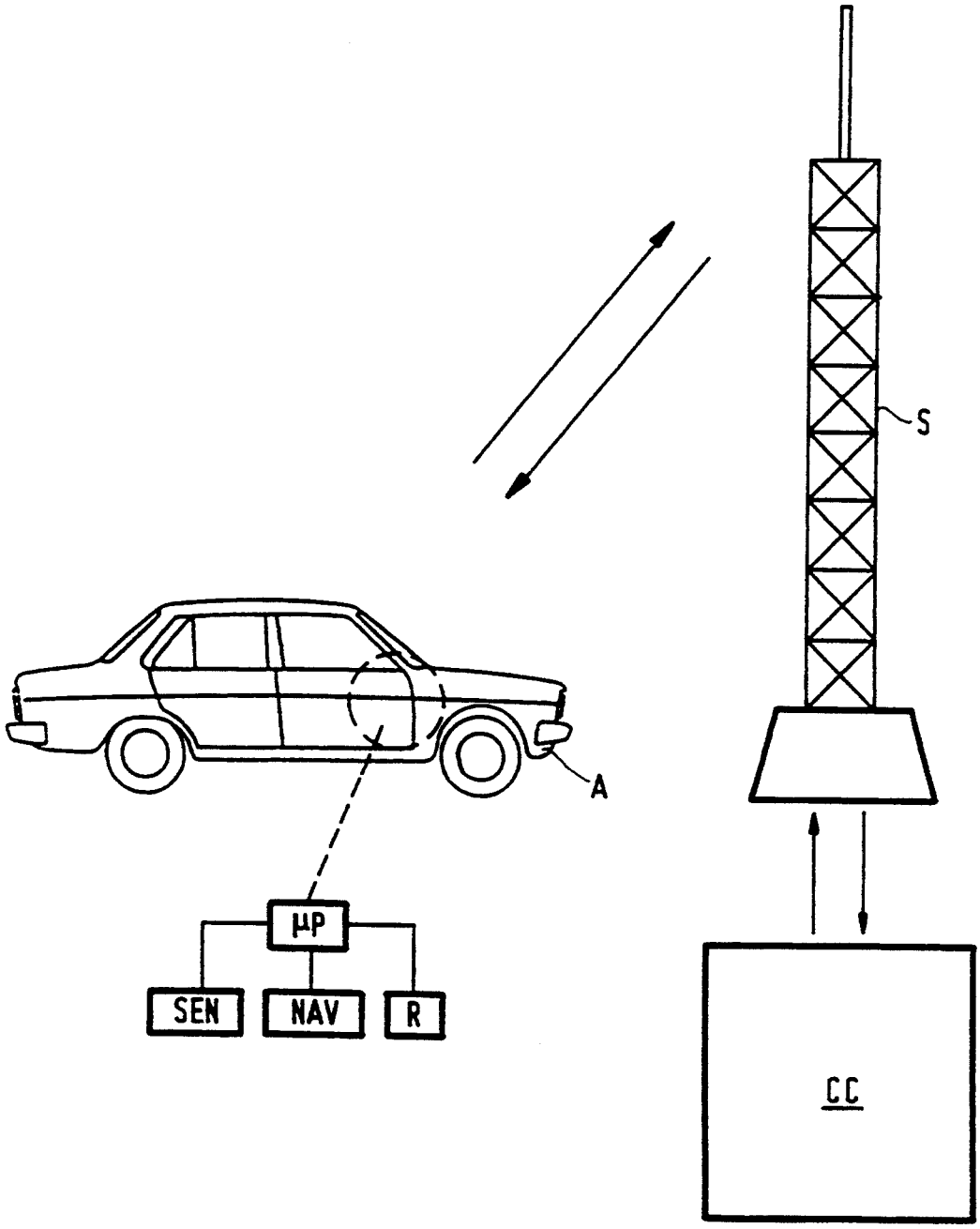
FIG. 4 shows a device in accordance with the invention.

FIG. 4 shows a device in accordance with the invention. Vehicle A comprises sensors SEN (for example, magnetic sensors for direction finding and wheel sensors for determining the distance travelled), a navigation device NAV with a digitized map of the geographic region which contains virtual reference positions, a radio unit R for transmitting and receiving data in a cellular radio communication system, and a microprocessor $\mu$P. The microprocessor is programmed to apply the measured values from the sensors to the navigation device which utilizes this data for accurate determination of the location and the direction of movement of the vehicle relative to virtual reference positions on the map. The microprocessor is also programmed to transmit measured values, such as indications of the route segment travelled to a passed intersection and of the route segment travelled beyond the intersection, via the radio unit R, to the transmitter/receiver station S which communicates with the central computer CC. The transmitter/receiver station S and the radio unit R form part of a cellular radio communication system. The central computer CC receives measured values from a number of vehicles via several transmitter/receiver stations and processes this information so as to form, for example traffic guidance recommendations which can be transmitted to the vehicles via the transmitter/receiver stations. The microprocessor $\mu$P in the vehicles applies this data to the navigation device which applies it to the driver of the vehicle. This can be realised in a visual manner, via a display screen, or audibly by means of a speech synthesizer.

I claim:

1. A method of collecting, processing and disseminating traffic flow information for a predefined geographic area serviced by a cellular radio system, said method comprising the steps of:

a. transmitting, from a plurality of cellular-radio-equipped vehicles travelling in the predefined geographic area to a cellular radio receiver in the cellular radio system, position information periodically identifying the respective positions of said cellular-radio-equipped vehicles relative to predetermined reference positions in said predefined geographic area;

b. processing the position information at a central processor in communication with the cellular radio receiver to produce an origin-destination matrix representative of the rates of travel of the cellular-radio-equipped vehicles along predefined route segments in the predefined geographic area;

c. transmitting, from a cellular radio transmitter in communication with the central processor to the cellular-radio-equipped vehicles travelling in the predefined geographic area, traffic-flow-rate information derived from the origin-destination matrix.

2. A method as in claim 1 where the predetermined reference positions comprise road junctions in the predefined geographic area.

3. A method as in claim 2 where the position information transmitted by each of the cellular-radio-equipped vehicles includes information identifying when said vehicle is present at each of the road junctions.

4. A method as in claim 2 where the position information transmitted by each of the cellular-radio-equipped vehicles includes information representing time spent travelling a completed one of the predefined route segments.

5. A traffic information system for collecting, processing and disseminating traffic flow information for a predefined geographic area serviced by a cellular radio system, said traffic information system comprising:

a. a cellular radio receiver for receiving, from a plurality of cellular-radio-equipped vehicles travelling in the predefined geographic area, position information periodically identifying the respective positions of said cellular-radio-equipped vehicles relative to predetermined reference positions in said predefined geographic area;

b. a central processor in communication with the cellular radio receiver for processing the position information to produce an origin-destination matrix representative of the rates of travel of the cellular-radio-equipped vehicles along predefined route segments in the predefined geographic area;

c. a cellular radio transmitter in communication with the central processor for transmitting, to the cellular-radio-equipped vehicles travelling in the predefined geographic area, traffic-flow-rate information derived from the origin-destination matrix.

6. A traffic information system as in claim 5 where the predetermined reference positions comprise road junctions in the predefined geographic area.

7. A traffic information system as in claim 6 where the position information transmitted by each of the cellular-radio-equipped vehicles includes information identifying when said vehicle is present at each of the road junctions.

8. A traffic information system as in claim 6 where the position information transmitted by each of the cellular-radio-equipped vehicles includes information representing time spent travelling a completed one of the predefined route segments.

* * * * *